United States Patent [19]

Kolaian et al.

[11] 4,271,032

[45] Jun. 2, 1981

[54] POLYCARBOXYLIC ACIDS AND ESTERS IN DETERGENT FORMULATIONS AND THEIR USE

[75] Inventors: Jack H. Kolaian, Wappingers Falls; Richard F. Love, Fishkill, both of N.Y.

[73] Assignee: Texaco Inc., White Plains, N.Y.

[21] Appl. No.: 54,729

[22] Filed: Jul. 5, 1979

[51] Int. Cl.[3] ..... C11D 3/20

[52] U.S. Cl. ..... 252/174.19

[58] Field of Search ..... 252/174.19; 560/190, 560/180, 122

[56] References Cited

U.S. PATENT DOCUMENTS

| | | | |
|---|---|---|---|
| 3,769,223 | 10/1973 | Pearson et al. | 252/174.19 |
| 3,776,850 | 12/1973 | Pearson et al. | 252/174.19 |
| 3,776,851 | 12/1973 | Cheng | 252/174.19 X |
| 3,816,318 | 6/1974 | Hentschel | 252/174.19 |
| 3,976,586 | 8/1976 | Chakrabarti | 252/174.19 X |
| 3,989,634 | 11/1976 | Prochazka et al. | 252/546 X |

FOREIGN PATENT DOCUMENTS

| | | | |
|---|---|---|---|
| 2240856 | 3/1974 | Fed. Rep. of Germany | 252/174.19 |
| 2302873 | 8/1974 | Fed. Rep. of Germany | 252/174.19 |
| 2230719 | 12/1974 | France | 252/174.19 |
| 48-64103 | 9/1973 | Japan | 252/174.19 |
| 50-05723 | 3/1975 | Japan | 252/174.19 |
| 50-92306 | 7/1975 | Japan | 252/174.19 |
| 1518321 | 7/1978 | United Kingdom | 252/174.19 |
| 1518322 | 7/1978 | United Kingdom | 252/174.19 |

*Primary Examiner*—Harris A. Pitlick

*Attorney, Agent, or Firm*—Carl G. Ries; Robert A. Kulason; Bernard Marlowe

[57] ABSTRACT

This invention concerns the use of certain polycarboxylic acids and their esters as biodegradable detergents and detergent builders in the laundering of soiled fabrics.

3 Claims, No Drawings

POLYCARBOXYLIC ACIDS AND ESTERS IN DETERGENT FORMULATIONS AND THEIR USE

BROAD DESCRIPTION OF THE INVENTION

This invention concerns the use of certain polycarboxylic acids and their monoesters which can be used as both detergents and detergent builders for the removal of soil from fabrics in laundering processes.

More particularly, this invention concerns the use of an experimental group of saturated aliphatic polycarboxylic acids which can be used as detergent builders and their monoesters which are effective as detergents and combination of detergents and builders.

BACKGROUND OF THE INVENTION

There is no paucity of surfactants and builders for use in detergent compositions per se. However, the most widely used detergents for home laundry use, use linear alkyl-benzene sulfonates (LABS) or alcohol ethoxylates as detergent and sodium tripolyphosphate STPP as a builder. The use of sodium tripolyphosphate (STPP) as a builder has drawbacks for example the presence of phosphate in rivers and lakes causes eutrophication. Similarly the biodegradable ethoxylated alcohols are relatively costly compared to their precursor alcohols and, while effective against soiled synthetics, are borderline for the laundering of cellulosics such as cotton.

In view of the different characteristics now required of detergents such as good biodegradability, compatibility with other detergents, builders, good launderability against both natural and synthetic fabrics, as well as low mammalian toxicity and the like, the development of multifunctional detergents combining several of these properties can represent a distinct advance in the art.

Recently, the applicants have discovered that certain polycarboxylic acids containing 3 or 4 unesterified carboxylic acid groups on a saturated aliphatic chain are good detergent builders when combined with other detergents and/or builders. For example, these polycarboxylic acids in the form of their sodium salts were evaluated as builders with standard detergents such as linear alkylbenzene sulfonate (LABS). As shown in subsequent data, the detergent building properties of all 6 illustrative polycarboxylic acids exemplified are equal or superior to sodium tripolyphosphate (S.T.P.P.) or citric acid.

The monodecyl esters of the polycarboxylic acids can function as to a limited degree as surfactants in addition to being builders. Thus, they show promise as combination detergent-builders with LABS.

Data presented below show that the monoesters as builders are superior to STPP. As surfactants, when formulated with STPP the esters are generally superior to normal paraffin sulfonate (NPS) but are less effective generally than (LABS) on cotton test cloth. In general, the monodecyl esters are less effective in tests performed on synthetic fabrics.

SUMMARY OF THE INVENTION

In its broadest contemplated formulation embodiment, this invention relates to a laundering process using a novel group of saturated linear aliphatic polycarboxylic acids and their monoesters possessing utility as detergents, detergent builders and detergent-builder combination, said acids and/or esters being present in at least a laundering amount, in an aqueous system containing soiled synthetic and/or cellulosic fabrics, said aqueous systems optionally containing other alkaline builders and additives generally referred to as laundering adjuvants.

To further aid in the more thorough understanding of the invention concept, the following additional disclosure is submitted:

A. "Detergent" as used throughout this application, is the detergent component which exerts or contributes the primary cleaning power or cleansing effect upon the soiled substrate to be treated.

In this invention the detergents or detergent builders are selected from the group of saturated aliphatic polycarboxylic acids containing 3 or 4 unesterified carboxylic acid groups in the saturated aliphatic chain exclusive of the carbon atoms in the alcohol chain which can range between 12 and 30 carbon atoms. The preferred polyboxylic acids are selected from the group consisting of 1,2,3-propane tricarboxylic acid (PTCA), 1,2,4-butane tricarboxylic acid (BTCA), 1,2,3,4-cyclopentane tetracarboxylic acid (CPTCA), 1,3,4-cyclopentane tricarboxylic acid and 2,3,5-tricarboxycyclopentane acetic acid (TCPA) and mixtures thereof. As discussed earlier the polycarboxylic acids containing the 3 or 4 unesterified carboxylic acid groups were tested after conversion to the sodium or other alkaline salt.

The preparation of the monoesters of these polycarboxylic acids are generally carried out using the usual esterification techniques set forth in the patent and technical literature using alcohols whose carbon content ranges between 10 and 30. The preferred esters are selected from the group consisting of BTCA monodecyl ester, CPTA monodecyl esters and mixtures thereof.

Citric acid was the standard used to evaluate the polycarboxylic acids in the acid testing and citric acid monodecyl ester was the standard ester employed. Both the acids and esters can be in the form of single discrete acids or esters or they can be in the form of crude or purified mixtures.

B. Concentration—Inasmuch as the above-described polycarboxylic acids and esters are the primary source of cleansing (surfactant) power in the inventive detergent formulation, to function properly the aqueous cleaning bath containing the soiled substrate must contain at least a minimal amount of the polycarboxylic acid or esters to be effective. It has been determined experimentally that the acids must be present in quantities of at least 0.1% by weight of the laundry bath to be effective while at least 0.1% by weight of the esters are required. The upper limit does not appear to be critical to success of the detergent but quantities in excess of 1% by weight of the bath appear to be wasteful.

C. Cellulosic Substrate—As used throughout this disclosure, the substrates are natural cellulose or its modified derivatives. These include the cellulosic substrates, cotton, as well as linen, hemp, jute flax, cuprammonium rayon, viscose rayon and the like. The substrates can be used alone or in blends with synthetics such as polyester or polyamide. The cellulosics and their synthetic blends can be in the form of their yarns, fibers or threads, or in their manufactured form such as woven cloths, knitted fabrics, webs or any other fabricated form utilizing textile fabricating processes.

D. Builders—While the esters of this invention are useful alone as builders, they can be used in conjunction with other builders. In fact as the tabulated data on esters shows the inventive esters are effectively combined with sodium tripolyphosphate (STPP). Preferably, inorganic salts, such as the alkali metal salts and the like are employed as builders. For the sake of simplicity, these will be illustrated by the sodium salts although the other corresponding alkali metal salts can usually be substituted for sodium. Illustrative of such salts are $Na_2CO_3$, $NaHCO_3$, $Na_2HCO_3.Na_2CO_3$ (sodium sesquicarbonate) $Na_2B_4O_7.10H_{20}$ (Borax in the usual commercial form) $Na_4SiO_4$ (sodium orthosilicate), $Na_2SiO_3$ (sodium metasilicate) and sodium citrate, etc. In addition, for certain special detergent applications, neutral soluble salts such as sodium sulfate or sodium chloride can be employed with fatty alcohol surfactants of this invention.

E. Optional Detergent Adjuvants or Detergent Additives—Often, it is desirable to modify, alter or change one or more characteristics of a given detergent of this invention. The additives employed are generically referred to as "adjuvants." Ordinarily, they constitute from 1 to 10% by weight of the dry detergent composition, preferably between about 1 to 5% of the detergent composition. Among others, the following classes of adjuvants may be employed: anti-redeposition-compounds such as sodium carboxymethyl cellulose, starch derivatives, methyl cellulose, polyvinyl alcohol, polyvinylpyrrolidone, etc., heavy metal sequestering agents including ethylenediaminetetraacetic acid and its salts, citric acid salts and gluconic acid. Also present are optical bleach or brightening agents, corrosion inhibitors, tarnish inhibitors, germicides and the like.

F. Formulation of Inventive Detergent Compositions—No specific mode or order of addition of detergent components is required to formulate the multi-component detergents of this invention. Ordinarily, free flowing, finely divided homogeneous, granular detergents are made by intimately grinding the detergent with the builder and any other detergent additives or adjuvants employed are then added and blended in. The control examples were prepared in a similar manner.

G. Initial Screening Procedure using Launder-Ometer Test Procedures Expressed as Average Reflectance—Multiple test samples of 4 cotton cloths, $2\frac{1}{4}''$ in diameter in size, 3 soiled and one unsoiled cloth, are charged to Launder-Ometer cannisters containing appropriate amounts of linear alkylbenzene sulfonate, experimental surfactant, hard water (standard hard water made up to a total hardness of 3000 p.p.m. with $Ca^{++}$ and $Mg^{++}$) and sufficient distilled water to produce a final concentration of surfactant of 0.1 percent and 0.2 percent in each of two cannisters. The builder/detergent ratio is initially 70/30. The total hardness of the solution is about 300 p.p.m.

After the cannisters are sealed, the Launder-Ometer is run for 10 minutes at a predetermined temperature, 60° C. At the end of this time, the test swatches are removed from the cannisters, rinsed twice with distilled water and dried.

The effectiveness of the test—detergent solution is obtained by determining the amount of soil removed from the soiled test cloth sample using a reflectometer. Average reflectance value is read directly from the instrument.

(2) Using the identical test procedure described previously in the screening tests, reflectance values of unsoiled (Ruu), washed soiled (Rsw) and soiled unwashed cloth (Rsu) are used to calculate percent detergency as follows:

$$\text{Per Cent Detergency} = \frac{Rsw - Rsu}{Ruu - Rsw}(100)$$

Using this approach, maximum detergency (100%) corresponds to a reflectance value equal to that of the unsoiled cloth. Since the detergent effectiveness can be related to the effectiveness of the comparison standard, this approach calculates the percent detergency similar to that used above and relates this value to the percent detergency of the standard, thus giving a detergency coefficient as shown below:

$$\text{Detergency Coefficient} = \frac{\text{Per Cent Detergency Exp. Surfactant}}{\text{Per Cent Detergency Std. Surfactant}}(100)$$

(3) Detergent coefficient values less than 90 indicate an experimental material to be less effective than the standard, while values above 110 indicate greater effectiveness than the standard.

Unless otherwise specified, all parts or percentages are by volume and all temperature measurements are in degrees Centigrade rather than Fahrenheit.

Following is a description by way of example of a preferred method for practicing the inventive concept.

EXAMPLE 1

Preparation of 1,2,3,4-Butane Tetracarboxylic Acid Monododecyl Ester

A blend of 1,2,3,4-butane tetracarboxylic acid (28.5 g., 0.121 mole), dodecyl alcohol (21.8 grams, 0.118 mole), p-toluenesulfonic acid (0.1 gram, 0.6 mole) and 300 ml. (3.4 moles) of dioxane was placed in a Soxhlet apparatus containing 4A molecular sieve. The mixture was brought to reflux with the vapor condensate passing through the molecular sieve to remove water formed during the reaction. After 48 hours reflux, the dioxane solution was removed and stripped of solvent under reduced pressure (20 mm.). The residue (50 grams) showed the presence of both carboxylic acid and ester groups in the infrared.

Anal. for $C_{20}H_{36}O_8$ Calc'd: C=59.5, H=8.97. Found: C=59.8, H=8.0.

EXAMPLE 2

Preparation of Citric Acid Dodecyl Ester

A blend of citric acid (63 grams, 0.3 mole), dodecyl alcohol (55.8 grams, 0.31 mole), p-toluene sulfonic acid (0.1 gram, 0.6 mole) and 300 ml. of dioxane was refluxed for 72 hours, passing the condensed vapor through 4A molecular sieve. The dioxane solvent was then evaporated under reduced pressure (30 mm.) to a 150 gram residue. This mixture was diluted with 200 ml. of toluene and the reaction mixture subsequently stripped to 60° C. at 5 mm. pressure. The residue was an amber oil which solidified to a cream colored soft solid, weight 106.6 grams (Theory 108 grams).

Anal. for $C_{18}H_{32}O_7$ Calc'd: C=60.2, H=8.96. Found: C=61.5, H=8.4.

EXAMPLE 3

Preparation of 1,2,3,4-Cyclopentane tetracarboxylic acid, Monododecyl ester

A blend of 1,2,3,4-cyclopentane tetracarboxylic acid (35 grams, 0.143 mole), dodecyl alcohol (26.6 g., 0.143 mole), p-toluene-sulfonic acid ( 0.1 gram, 0.6 mole) and 300 ml. of dioxane was refluxed as above for 48 hours. Solvent then was stripped to leave a residue of 58 grams.

Anal. for $C_{21}H_{34}O_8$ Calc'd: C=60.8, H=8.28. Found: C=61.8, H=8.2.

For polycarboxylic acid evaluation, the polycarboxylic acids were used as the builders and a linear alkyl benzene sulfonate, Nacconol 90F, was used as the surfactant. In the ester evaluations monoesters of polycarboxylic acids were evaluated as detergents and/or builders.

Stock solutions of the polycarboxylic acids and the monodecylesters were prepared by making a 1% wt./v solution neutralized to pH 8.5 with sodium hydroxide. The stock solutions of Nacconol 90F and sodium tripolyphosphate (STPP), were also 1% wt./v.

200 ml. of solution for evaluation in the launderometer was prepared in which the ratio of builder to detergent was 70/30. Solutions at 0.1% and 0.25% active ingredients were prepared. Table I details the volumes of solutions and water required to prepare the launderometer test solutions above.

TABLE I

| Detergent | Composition of Test Solutions: Concentra-Active Ingredient % | Hard Water Ml, 5000 PPM $Ca^{++}$,$Mg^{++}$ | Distilled Water, Ml. | Ml. Builder 1% STPP, Ml. | Ml. % Detergent Soln., Ml. |
|---|---|---|---|---|---|
| Citric Acid Monododecyl ester | 0.1 | 20 | 113.4 | 46.6 | 20 |
| " | 0.2 | 20 | 46.8 | 93/2 | 40 |
| BTCA Monododecyl ester | 0.1 | 20 | 113.4 | 46.6 | 20 |
| " | 0.2 | 20 | 46.8 | 93.2 | 40 |
| CPTA Monododecyl ester | 0.1 | 20 | 13.4 | 46.6 | 20 |
| " | 0.2 | 20 | 46.8 | 93.2 | 40 |
| Naccanol 90 F | 0.1 | 20 | 113.4 | 46.6 | 20 |
| " | 0.2 | 20 | 46.8 | 93.2 | 40 |
| SAS-60 | 0.1 | 20 | 113.4 | 46.6 | 20 |
| " | 0.2 | 20 | 46.8 | 93.2 | 40 |

TABLE II

LAUNDEROMETER TESTS OF POLYCARBOXYLIC ACIDS AND SOME MONODODECYL POLYCARBOXYLATES AS DETERGENTS AND DETERGENT BUILDERS

| Ex. | Chemical Composition | Detergent or Builders Added | Detergency Coefficient [Sodium tripolyphosphate (STPP) + 100] Fabrics: Cotton | Dacron Cotton (pp)[2] | Nylon |
|---|---|---|---|---|---|
| | Polycarboxylic Acids as Builders[1] | | | | |
| 4 | Citric Acid | Nacconol 90F | 100–110 | 108 | 105,101 |
| 5 | 1,2,3-Propane tricarboxylic Acid (PTCA) | " | 101 | — | — |
| 6 | 1,2,4-Butane tricarboxylic Acid (BTCA) | " | 104 | — | — |
| 7 | 1,2,3,4-Butane tetracarboxylic Acid (BTCA) | " | 115 | 107 | 88 |
| 8 | 1,2,3,4-Cyclopentane tetracarboxylic Acid (CPTA) | " | 112 | 126 | 99 |
| 9 | 1,2,4-Cyclopentane tricarboxylic Acid (CPTCA) | " | 113 | — | — |
| 10 | 2,3,5-Tricarboxycyclopentane Acetic Acid (TCPA) | " | 103 | — | — |
| | Monododecyl Esters as Detergents and Builders | | | | |
| 11 | Citric Acid, monododecyl ester | Nacconol 90F | 113 | 144 | 103 |
| 12 | BTCA, monododecyl Ester | " | 103,113 | 80 | 111 |
| 13 | CPTA, monododecyl Ester | " | 113 | 90 | 108 |

[1]All materials tested on an equal weight basis.
[2]Dacron-cotton permanent press.

The evaluation of the polycarboxylic acids as builders compare favorably with the citric acid used as a comparison standard in this group of runs.

The three dodecyl esters also compare favorably to citric acid used as a comparison standard.

TABLE III

LAUNDEROMETER TESTS OF POLYCARBOXYLIC ACIDS AND SOME MONODODECYL POLYCARBOXYLATES AS DETERGENTS AND DETERGENT BUILDERS

Monododecyl Esters as Detergents

| Ex. | Monododecyl Esters as Detergents | Detergent or Builders Added | Detergency Coefficient [Sodium tripolyphosphate (STPP) = 100] Fabrics: Cotton | Dacron Cotton (pp)[2] | Nylon |
|---|---|---|---|---|---|
| 14 | Citric Acid, monododecyl Ester | None | 75,78 | 27 | −12 |
| 15 | Citric Acid, monododecyl Ester | STPP | 81 | 51,67 | 67 |
| 16 | BTCA, monododecyl Ester | None | 71 | — | — |
| 17 | BTCA, monododecyl Ester | STPP | 90,88 | 59 | 84 |
| 18 | CPTA, monododecyl Ester | None | 87 | — | — |
| 19 | CPTA, monododecyl Ester | STPP | 93 | 85 | 102 |
| 20 | Nacconol 90F (linear alkyl-benzene sulfonate) | STPP | 100 | 100 | 100* |
| 21 | SAS-60 (Normal paraffin sulfonate) | STPP | 80,82 | 105 | 100 |

[1]All materials tested on an equal weight basis.
[2]Dacron-Cotton permanent press.
*Assigned rating for comparison purposes.

In Table III comparative runs were made wherein STPP as builder is compared to the dodecyl ester alone. Nacconol-90F with STPP is considered the standard to comparison of all the tests shown in Tables II and III.

What is claimed is:

1. A process for removing the soil from soiled cellulosic fabric in an aqueous laundering environment consisting essentially of contacting the soiled fabric to be cleaned in the aqueous environment with a detergent composition having as its active components:

from about 0.05 to 5 parts by weight of at least one saturated linear aliphatic carbon-carbon backbone polycarboxylic acid selected from the group consisting of 1, 2, 4-cyclopentane tricarboxylic acid and 2, 3, 5-tricarboxycyclopentane acetic acid, and at least one member selected from the group consisting of (a) from about 0 to 5 parts by weight of a builder material, and (b) from about 1 to 10 parts by weight of detergent additive material and continuing said contact of the soiled fabric with the aqueous laundering environment until substantially all of the soil has been removed from said soiled fabric.

2. The process of claim 1 wherein the acid is 1,2,4-cyclopentane tricarboxylic acid.

3. The process of claim 1 wherein the acid is 2,3,5-tricarboxycyclopentane acetic acid.

* * * * *